United States Patent [19]

Allen

[11] Patent Number: 4,536,033

[45] Date of Patent: Aug. 20, 1985

[54] TRASH STORING APPARATUS

[76] Inventor: Webster F. Allen, 3005 37½ St., NW., Billings, Mont. 59102

[21] Appl. No.: 519,003

[22] Filed: Aug. 1, 1983

[51] Int. Cl.[3] ..... B65F 1/00

[52] U.S. Cl. ..... 298/2; 298/10; 414/421; 280/47.34

[58] Field of Search ..... 298/2, 5, 10; 414/421, 414/404, 406, 403, 419, 420; 296/101; 280/47.34

[56] References Cited

U.S. PATENT DOCUMENTS

| | | | |
|---|---|---|---|
| 1,220,640 | 3/1917 | Kelly | 414/421 X |
| 1,495,477 | 5/1924 | Gammeter | 298/5 |
| 2,513,076 | 6/1950 | Blasiola | 414/421 |
| 3,750,810 | 8/1973 | Stanfill | 414/421 |
| 3,875,981 | 4/1975 | Brenner et al. | 298/2 |

FOREIGN PATENT DOCUMENTS

| | | | |
|---|---|---|---|
| 1072511 | 2/1980 | Canada | 414/421 |

*Primary Examiner*—Robert J. Spar
*Assistant Examiner*—Ken Muncy
*Attorney, Agent, or Firm*—Arthur L. Urban

[57] ABSTRACT

Trash storing apparatus includes a support portion, a container portion and a container dumping portion. The support portion includes a substantially horizontal frame section with an undercarriage section including a plurality of wheels extending downwardly from the horizontal frame section, an upstanding frame section extending upwardly from the horizontal frame section adjacent one end thereof and an inclined frame section extending from adjacent an opposite end of the horizontal frame section to a point adjacent the upper end of the upstanding frame section. The container portion normally rests on the inclined frame section of the support portion and extends from adjacent the lower end of the inclined frame section upwardly beyond the upper end of the upstanding frame section. The container portion also including a receptacle member with an open upper end and a cover member pivotally connected adjacent an edge of the open end of the receptacle member. The container dumping portion includes a pivotal connection between the container portion and the inclined frame section adjacent the upper end of the upstanding frame section, a handle disposed adjacent the bottom of the receptacle member. Trash is placed into the receptacle member by opening the cover member and trash is removed from the receptacle member by grasping the handle and raising the lower end of the receptacle member so that it pivots about the pivotal connection to empty the trash through the open end.

11 Claims, 6 Drawing Figures

TRASH STORING APPARATUS

This invention relates to a novel trash storing apparatus and more particularly relates to a new movable trash storing apparatus.

BACKGROUND OF THE INVENTION

The disposal of trash and other refuse such as garbage and the like has been a problem that has increased through the ages. Originally, before the development of cities and towns, the disposing of trash was not a major concern. Very few products were packaged at all, much less in glass, metals, plastics and similar materials. As a result, few, if any, wrapping or containers had to be discarded. Furthermore, since most people did not live in large groups, trash could be discarded in a place where it did not interfere with other persons.

However, as civilization has developed, more and more people migrated to towns and cities. Also, society has become more concerned about pollution. These factors have made the disposal of trash more of a problem. Citizens could not simply discard trash where they wanted since their disposal point might interfere with the living conditions of others nearby.

This interference with others by improper trash disposal can take the form of unsightliness of property or may be health problems due to contamination of food or water supplies. Also, the trash may be a breeding place for mosquitoes, rodents or other pests.

Because of the problems created by thoughtless disposal of trash, governments have had to make rules to control trash disposal. Such rules may specify the manner in which trash can be handled such as the location and type of trash storage containers. In addition, many governments have inaugurated or developed trash collection services in order to achieve orderly trash disposal and removal.

While trash removal services have been successful to a considerable extent, recent changes in life styles and the high cost of government operations has resulted in serious evaluations by individuals and the community of trash storage and removal operations.

Since taxes for government operations have increased drastically in recent years, people have chosen officials who have pledged economy and cost reductions. One way in which the costs have been reduced has been by streamlining trash collection procedures. This has been accomplished by limiting the collection points and frequency. These changes have placed a greater burden on the individual.

Fewer collection points require that the trash be carried longer distances either each day or else the transfer of filled containers prior to each collection time. Less frequent trash collection necessitates provision for larger or more numerous trash containers to hold the greater amount of trash accumulated between collections.

Persons who have moved to rural areas encounter different trash disposal problems. They may reside in locations that do not have government or private trash collection service. They have to provide for their own trash removal. Ordinarily, this involves providing storage containers and then taking the collected trash to a dump periodically.

Changes in trash collection procedures have increased the trash awareness of many persons since they have to handle trash much more than they previously did. While the handling of small quantities of trash is simply a troublesome chore, handling containers filled with trash can present major problems. Large and/or heavy trash containers are awkward to hanndle, and many people may not even be able to lift a loaded trash container.

In an attempt to simplify the handling of trash, a variety of trash containers and handling equipment has been developed. One is a carrier similar to a wheelbarrow in which conventional containers fit. The carrier has a wheel at one end and handles at the opposite end. While such carriers may be useful for some people, they still require that the user be able to maneuver the loaded wheelbarrow from a storage location to a collection point. Also, they are not useful for rural residents who have to haul their own trash since the containers still have to be lifted or dumped into a vehicle.

From the above discussion, it is clear that present methods for disposing of trash are not satisfactory in many situations. Thus, there is a need for a new trash storage container that overcomes the deficiencies of such procedures.

SUMMARY OF THE INVENTION

The present invention provides a novel trash storing apparatus. The trash storing apparatus of the invention can be used conveniently in situations where conventional trash storage and removal procedures are not usable. The trash storing apparatus permits a large quantity of trash to be stored in a single container. The trash storing apparatus can be moved from a storage location to a collection point easily.

The trash storing apparatus of the invention facilitates the loading of trash into a truck. The trash storing apparatus can be used efficiently by persons of all ages after only a minimum of instruction. The trash storing apparatus can be used successfully by persons with limited strength and stamina.

The trash storing apparatus of the present invention is simple in design and relatively inexpensive. The apparatus can be fabricated from commercially available materials and components. Conventional fabrication techniques and procedures can be utilized in its manufacture.

The trash storing apparatus of the invention is durable in construction and has a long useful life. Minimum maintenance is required to keep the apparatus in good working condition. The trash apparatus can be adapted easily to satisfy different requirements and conditions.

These and other benefits and advantages of the novel trash storing apparatus of the present invention will be apparent from the following description and the accompanying drawings in which:

DESCRIPTION OF PREFERRED EMBODIMENTS

Figure 1:
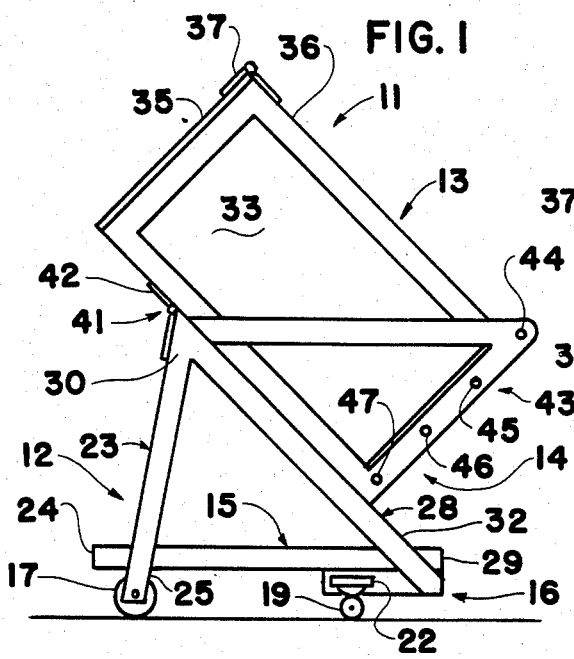
FIG. 1 is a side elevation of one form of the trash storing apparatus of the invention.
Figure 2:
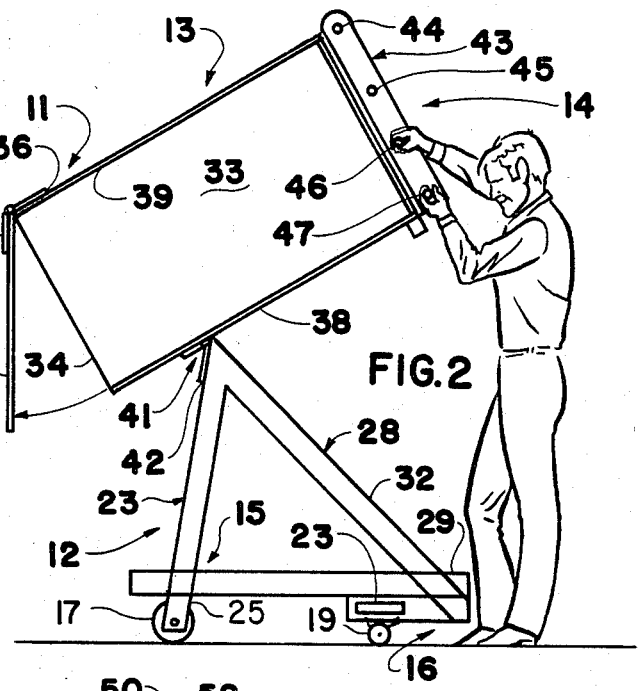
FIG. 2 is a side view in section of the trash storing apparatus shown in FIG. 1 in a dumping position.
Figure 3:
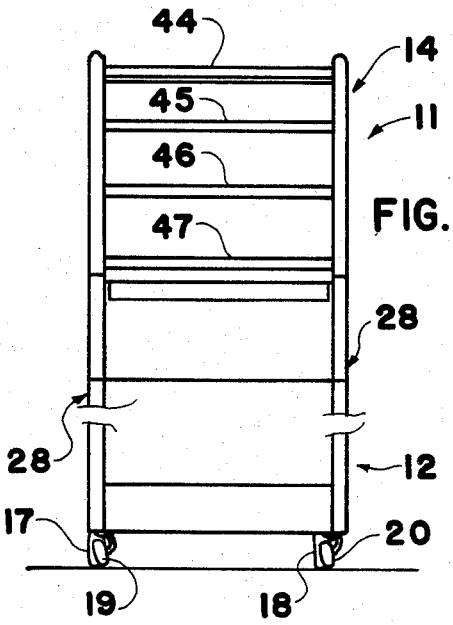
FIG. 3 is a right end view of the trash storing apparatus as shown in FIG. 2.

As shown in FIGS. 1-3 of the drawings, one form of the novel trask storing apparatus 11 of the present invention includes a support portion 12, a container portion 13 and a container dumping portion 14.

The support portion 12 of the trash storing apparatus 11 of the invention includes a substantially horizontal frame section 15. An undercarriage section 16 extends downwardly from the horizontal frame section 15. The undercarriage section 16 includes a plurality of wheels 17, 18, 19 and 20. Preferably, adjustable means e.g. slidable transverse members 22 extend in opposite directions from the horizontal frame section 15 to increase the spacing between at least two of the wheels shown in the drawings as caster wheels 19 and 20.

The support portion 12 further includes an upstanding frame section 23 extending upwardly from the horizontal frame section 15 adjacent one end 24 thereof. The upstanding frame section 23 advantageously is disposed generaly vertically. Preferably, wheels such as wheels 17 and 18 are mounted on downwardly extending ends 25 and 26 of the upstanding frame section.

An inclined frame section 28 extends from a point adjacent an opposite end 29 of the horizontal frame section 15 to a point adjacent the upper end 30 of the upstanding frame section 23. The inclined frame section 28 preferably extends from the end 29 of the horizontal frame section 15 up to the upper end 30 of the upstanding frame section 23. The angle of inclined frame section 28 may be changed by shifting the connecting point between the upstanding section 23 and the inclined section 28.

The container portion 13 of the trash storing apparatus 11 normally rests on the inclined frame section 28 of the support portion 12. The container portion 13 extends from adjacent the lower end 32 of the inclined frame section and upwardly therealong beyond the upper end 30 of the upstanding frame section 23.

The container portion 13 includes a receptacle member 33 with an open upper end 34. A cover member 35 is pivotally connected to the open end 34 of the receptacle 33 adjacent an edge of the open end, and preferably an upper edge 36. The cover 35 advantageously is pivotally connected through hinges 37.

The receptacle member 33 preferably has a generally box shaped configuration. Advantageously, one side section 38 of the receptacle rests on the inclined frame section 28. The receptacle member 33 preferably includes a moisture resistant inner surface or liner 39.

The container dumping portion 14 of the trash storing apparatus 11 includes pivotal connecting means 41 located between the container portion 13 and the inclined frame section 28 adjacent the upper end 30 of the upstanding frame section 23. The pivotal connecting means 41 advantageously includes hinge sections 42.

The container dumping portion also includes handle means 43. The handle frame 43 is disposed adjacent the bottom the receptacle member 33. As shown in FIGS. 2 and 3, the handle means 43 preferably includes a plurality of substantially parallel spaced grip sections 44–47 disposed along the bottom of the receptacle member 33.

Figure 4:
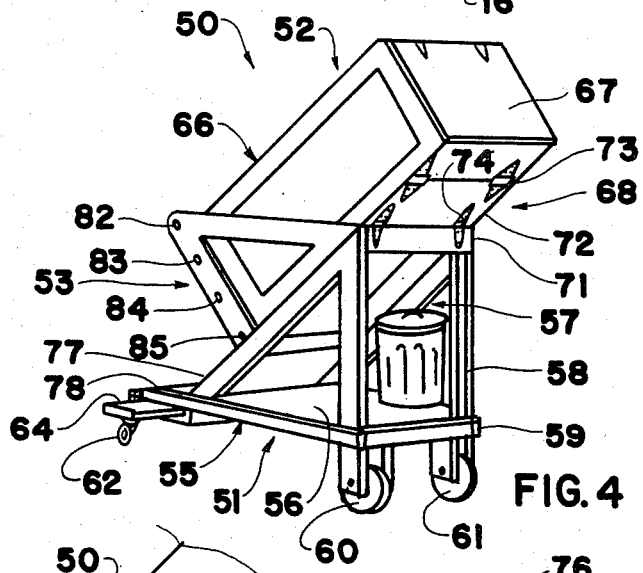
FIG. 4 is a view in perspective of another form of the trash storing apparatus of the invention.
Figure 5:
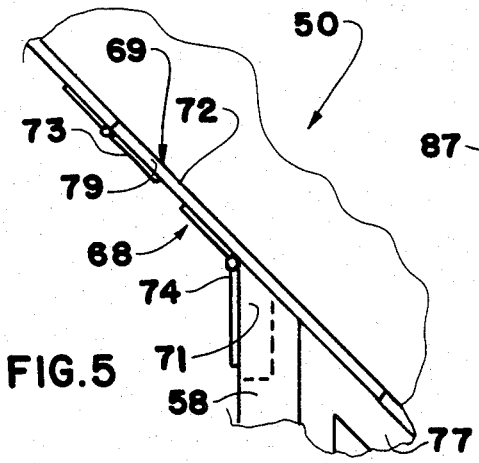
FIG. 5 is an enlarged fragmentary side view of the trash storing apparatus shown in FIG. 4.
Figure 6:
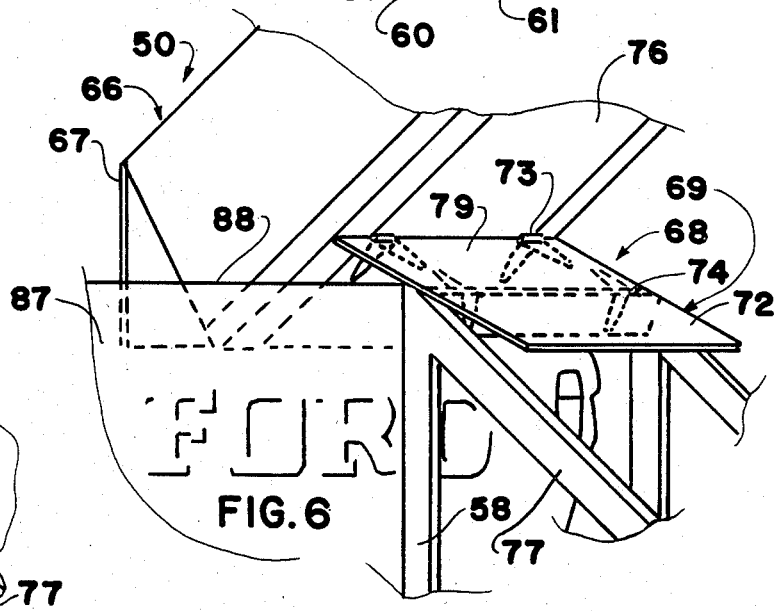
FIG. 6 is a fragmentary view in perspective of the trash storing apparatus shown in FIG. 5 in a dumping position.

FIGS. 4, 5 and 6 of the drawings illustrate another form of the trash storing apparatus of the invention. Trash storing apparatus 50 is similar to apparatus 11 described above and includes a support portion 51, a container portion 52 and a container dumping portion 53.

The support portion 51 includes a horizontal frame section 55 with a shelf 56 that serves as a supplemental storage section 57. The storage section 57 may be accessible through a vertical upstanding frame section 58 extending upwardly from one end 59 of the horizontal frame section 55.

The support portion 51 also includes wheels 60, 61 and a pair of wheels 62 (one of which is not shown). Wheels 62 advantageously are caster wheels mounted on slidable members 64 that extend in opposite directions from the horizontal frame section 55. FIG. 4 shows a transverse member 64 in an extended position.

The container portion 52 of the apparatus 50 includes an inclined receptacle member 66 with a cover 67. The receptacle 66 may be similar to receptacle 33 shown in FIGS. 1–3.

The container dumping portion 53 differs from the corresponding portion 14 of the apparatus 11. The pivotal connecting means 68 of the container dumping portion 53 includes spacer means 69 adjacent the upper end 71 of the upstanding section 58. The spacer means 69 may include a panel 72 that is pivotally connected both to the upper end of the upstanding frame section 58 and also pivotally connected to the lower surface of the container portion 52 at a point thereon a significant distance above the upper end 71 of the upstanding section. The pivotal connections preferably include hinge sections 73 and 74.

In the normal rest position of the container portion 53 as shown in FIGS. 4 and 5, the panel 72 lies between and is parallel to the bottom section 76 of the receptacle 66 and inclined frame section 77 that connects the upper end 71 of the upstanding section 58 with opposite end 78 of the horizontal frame section 55.

FIG. 6 illustrates the apparatus 50 in a dumping position. The receptacle 66 is pivoting about hinges 73 at upper end 79 of the spacer panel 72, while the upper end 71 of upstanding frame section 58 acts as a second pivot point for the panel about hinges 74. This structural design allows the receptacle 66 to pivot about a higher point than the upper end of the upstanding frame section 58.

The trash storing apparatus of the present invention may be fabricated from a wide variety of different materials and components. Suitable structural materials include metals, wood, plastics, combinations thereof and the like. The receptacle member advantageously may be formed as a unitary structure such as by molding the receptacle of a plastic material as a single unit.

In the use of the trash storing apparatus 11 of the present invention, the apparatus 11 can be positioned at a convenient location for periodic loading such as close to a door of a home or inside a garage or a similar outbuilding. Trash can be placed into the apparatus 11 in its rest position as shown in FIG. 1 simply by walking to the left end of the apparatus and raising the cover 35. The trash is inserted into receptacle 33 through open upper end 34.

Since the cover is hinged as its upper edge, the cover automatically closes when it is released. The trash is collected in the enclosed receptacle until it is filled. Since the size of the receptacle can be equivalent to several conventional trash cans, the receptacle needs to be emptied only infrequently. With the trash stored within the closed receptacle, it is safe from animals, birds and small children.

When it is desired to dispose of the trash, the apparatus 11 is rolled to a transfer point. The caster wheels 19 and 20 can be pulled to an extended position to add stability during movement. If the trash is to be transferred to a trash receiver such as a truck or a special trash collection vehicle, the apparatus is placed alongside the trash receiver.

The trash is emptied from the apparatus 11 by grasping the closest grip section 44 of handle means 43 and raising it. Then the second grip 45 is grasped and lifted so the lower end of the receptacle is raised further. This sequence is repeated by grasping each succeeding grip section 46 and 47 and raising the receptacle further. When the lower end of the receptacle is positioned above the pivot point at the upper end 30 of the upstanding frame section 23, the cover 35 of the receptacle will swing open automatically allowing the trash in the receptacle to slide therefrom into the trash receiver.

After all of the trash has been emptied from the receptacle 33, the lower end of the receptacle is lowered again to a rest position close to the horizontal frame section 15. This is accomplished by reversing the steps performed to empty the receptacle. The receptacle is lowered by grasping each successive grip section 44–47 and allowing it to move downwardly until the receptacle is in the rest position again.

The apparatus 11 then is returned to its loading location at which it is filled again and the sequence repeated. The ease and convenience with which the apparatus can be used greatly reduces the unpleasantness normally associated with trash disposal.

The trash storing apparatus 50 shown in FIGS. 4–6 is used in the same way as the apparatus 11. However, since the apparatus 50 includes a spacer panel 72 with two pivotal connections between the receptacle 66 and the upper end 71 of the upstanding section 58, the apparatus can be emptied into a trash receiver that has a threshold at a point above the upper end of the upstanding frame section.

The apparatus 50 can be positioned adjacent to a truck bed 87 with the cover 67 of the receptacle 66 above the upper edge or threshold 88. The receptacle is inverted by raising the lower end thereof with grip sections 82–85.

If the threshold 88 of truck bed 87 is at the level of the upper end 71 of the upstanding frame section 58, the receptacle will pivot about the lower hinged section 74 adjacent the upper end of the upstanding section. However, if the threshold 88 is at a higher level than the upper end 71 of the upstanding section 58, as shown in FIG. 6, the receptacle will pivot about the upper hinge section 73 at the top of the spacer panel 72.

Should the threshold 88 of the truck bed be at an intermediate height between the upper and lower hinge sections of the spacer panel, both hinge sections will be activated to some degree. Thus, the structural design utilizing the double hinged spacer panel provides a simple and convenient means for accommodating trash receivers of different heights.

The above description and the accompanying drawings show that the present invention provides a novel trash storing apparatus which overcomes shortcomings and deficiencies of conventional trash disposal methods. The trash storing apparatus of the invention facilitates the transfer of trash into trucks and other trash receivers. The apparatus permits the movement of trash from a storage location to a collection point easily and quickly.

The trash storing apparatus of the invention is simple in design and durable in construction. The apparatus can be fabricated from commercially available materials and components relatively inexpensively using conventional fabrication techniques. The apparatus has a long useful life with a minimum of maintenance.

The trash storing apparatus can be used by persons of all ages, even those with limited strength and dexterity. The trash apparatus can be employed successfully under a variety of different conditions and requirements.

It will be apparent that various modifications can be made in the particular trash storing apparatus described in detail and shown in the drawings within the scope of the invention. The size, configuration and arrangement of components can be different if desired. The horizontal, upstanding and inclined frame sections can be made adjustable. Also, the shape of the receptacle member can be different to meet specific requirements. These and other changes can be made in the trash storing apparatus of the invention provided the functioning and operation thereof are not adversely affected. Therefore, the scope of the invention is to be limited only by the following claims.

What is claimed is:

1. Trash storing apparatus including a support portion, a container portion and a container dumping portion; said support portion including a substantially horizontal frame section, an undercarriage section including a plurality of wheels extending downwardly from said horizontal frame section, an upstanding frame section extending upwardly from said horizontal frame section adjacent one end thereof, an inclined frame section extending from adjacent an opposite end of said horizontal frame section to a point adjacent the upper end of said upstanding frame section; said container portion normally resting on said inclined frame section of said support portion, said container portion extending from adjacent the lower end of said inclined frame section and upwardly therealong beyond the upper end of said upstanding frame section, said container portion including a receptacle member with an open upper end, a cover member pivotally connected adjacent an edge of said open end of said receptacle member; said container dumping portion including pivotal connecting means located between said container portion and said inclined frame section adjacent the upper end of said upstanding frame section, said pivotal connecting means including spacer means, said spacer means being pivotally connected through first hinge means adjacent the upper end of said upstanding frame section and said spacer means being pivotally connected through second hinge means to the lower surface of said container portion at a point thereon a significant distance above said upper end of said upstanding frame section, said second hinge means being spaced from said first hinge means, handle means disposed adjacent the bottom of said receptacle member; whereby trash can be placed into said receptacle member by opening said cover member and trash can be removed from said receptacle member by grasping said handle means and raising the lower end of said receptacle member so that it pivots about both of said hinge means of said pivotal connecting means to empty said trash through said open end thereof into a receiver having a threshold above the upper end of said upstanding frame section.

2. Trash storing apparatus according to claim 1 wherein said undercarriage section include means for increasing the spacing between at least two of said wheels.

3. Trash storing apparatus according to claim 1 wherein said undercarriage means includes sliding transverse members extending in opposite directions.

4. Trash storing apparatus according to claim 1 wherein said upstanding frame section is disposed generally vertically.

5. Trash storing apparatus according to claim 1 wherein at least two wheels are mounted on downwardly extending sides of said upstanding frame section.

6. Trash storing apparatus according to claim 1 wherein said receptacle member has a generally box shaped configuration.

7. Trash storing apparatus according to claim 6 wherein one side of said receptacle member rests on said inclined frame section.

8. Trash storing apparatus according to claim 1 wherein said receptacle member includes a moisture resistant inner surface.

9. Trash storing apparatus according to claim 1 wherein said cover member is pivotally connected to said receptacle member along the upper edge of said open end remote from said pivotal connection of saisd receptacle member with said inclined frame section.

10. Trash storing apparatus according to claim 1 wherein said handle means includes a plurality of substantially parallel spaced grip sections.

11. Trash storing apparatus according to claim 1 including a storage section on said horizontal frame section accessible through said upstanding frame section.

* * * * *